US006691373B2

(12) United States Patent
Leder

(10) Patent No.: US 6,691,373 B2
(45) Date of Patent: Feb. 17, 2004

(54) SLIDE GUIDE ASSEMBLY FOR TRAVELING FLATS IN A CARDING MACHINE

(75) Inventor: Armin Leder, Mönchengladbach (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 0 days.

(21) Appl. No.: 10/141,606

(22) Filed: May 9, 2002

(65) Prior Publication Data

US 2002/0129467 A1 Sep. 19, 2002

Related U.S. Application Data

(63) Continuation of application No. 10/071,212, filed on Feb. 11, 2002, now abandoned.

(30) Foreign Application Priority Data

Feb. 9, 2001 (DE) ..... 101 05 855

(51) Int. Cl.[7] ..... D01G 15/00

(52) U.S. Cl. ..... 19/98; 19/102; 19/103; 19/111

(58) Field of Search ..... 19/98, 102, 103, 19/110, 111, 113, 114

(56) References Cited

U.S. PATENT DOCUMENTS

| | | | | |
|---|---|---|---|---|
| 5,918,349 A | | 7/1999 | Leifeld et al. | 19/103 |
| 5,930,869 A | * | 8/1999 | Faas et al. | 19/98 |
| 6,047,446 A | * | 4/2000 | Leder et al. | 19/102 |
| 6,081,971 A | * | 7/2000 | Leder et al. | 19/102 |
| 6,085,390 A | * | 7/2000 | Leifeld | 19/113 |
| 6,269,522 B1 | * | 8/2001 | Graf et al. | 19/113 |

FOREIGN PATENT DOCUMENTS

| | | |
|---|---|---|
| DE | 41 250 035 | 2/1993 |
| DE | 2 320 260 A | 6/1998 |
| DE | 198 09 330 | 9/1999 |
| DE | 198 25 317 | 12/1999 |
| DE | 198 31 139 | 1/2000 |
| DE | 2 339 804 A | 2/2000 |
| EP | 0 476 407 | 3/1992 |
| EP | 1 178 136 A1 | 2/2002 |
| WO | 00/5441 | 2/2000 |

* cited by examiner

*Primary Examiner*—Gary L. Welch
(74) *Attorney, Agent, or Firm*—Venable LLP; Robert Kinberg; Stuart I. Smith

(57) ABSTRACT

A carding machine includes a carding cylinder and a plurality of traveling flat bars. Each flat bar has a flat bar clothing carried on an underside of the flat bar for cooperating with the cylinder clothing. The flat bar clothing of the flat bars is oriented at an adjustable angle to the cylinder clothing. Each flat bar has first and second flat bar parts at a longitudinal flat bar end. A first arcuate slide guide is supported adjacent a radial face of the carding cylinder, and the first flat bar part of the flat bars rides on the first slide guide. A second arcuate slide guide is supported adjacent the radial face of the carding cylinder, and the second flat bar part of the flat bars rides on the second slide guide. The second slide guide is wedge-shaped and is shiftable in a circumferential direction of the carding cylinder.

7 Claims, 6 Drawing Sheets

SLIDE GUIDE ASSEMBLY FOR TRAVELING FLATS IN A CARDING MACHINE

CROSS REFERENCE TO RELATED APPLICATIONS

This application is a continuation of Application Ser. No. 10/071,212 filed Feb. 11, 2002 Now abandoned.

This application claims the priority of German Application No. 101 05 855.1 filed Feb. 9, 2001, which is incorporated herein by reference.

BACKGROUND OF THE INVENTION

The invention relates to a device integrated in a carding machine for textile fibers, such as cotton fibers, chemical fibers or the like. The carding machine includes a traveling flats assembly which has clothed flat bars. Between the points of the flat bar clothing and the points of the main carding cylinder clothing a carding clearance is defined. The clothing of the flat bars is oriented at an adjustable angle to the cylinder clothing. One portion of the flat bar ends glide on a first arcuate slide guide and another portion of the flat bar ends glide on a second arcuate slide guide. The slide surface of one slide guide is radially adjustable.

In a known device, as disclosed, for example, in International Patent Document No. WO 00/05441, a setting device for a local adjustment of the flexible second slide guide is centrally disposed. Upon actuation, the second slide guide is moved radially inwardly or outwardly with respect to the carding cylinder axis. The setting device comprises a plurality of supporting elements which extend from a central supporting element and which carry the second arcuate slide guide. The supporting elements radially expand or contract in response to the position of the adjusting device. The adjusting device may operate hydraulically or pneumatically. It is a disadvantage of the above-outlined prior art device that it has a complex construction and further, the supporting elements engage the second slide guide only at dot-like locations. It is, however, a particular drawback that a uniform setting of the extremely small carding clearance (for example, 0.004 inches) between the clothing of the flat bars, on the one hand, and the cylinder clothing, on the other hand, is not possible. A non-uniform carding clearance leads to a deterioration in the quality of the fiber product, for example, sliver or yarn, and may also cause heavy damage to the carding machine.

SUMMARY OF THE INVENTION

It is an object of the invention to provide an improved device of the above-outlined type from which the discussed disadvantages are eliminated and which, in particular, makes possible a uniform and accurate setting of the angle between the clothing of the flat bars and the cylinder clothing rapidly and in a structurally simple manner.

This object and others to become apparent as the specification progresses, are accomplished by the invention, according to which, briefly stated, the carding machine includes a carding cylinder and a plurality of traveling flat bars. Each flat bar has a flat bar clothing carried on an underside of the flat bar for cooperating with the cylinder clothing. The flat bar clothing of the flat bars is oriented at an adjustable angle to the cylinder clothing. Each flat bar has first and second flat bar parts at a longitudinal flat bar end. A first arcuate slide guide is supported adjacent a radial face of the carding cylinder, and the first flat bar part of the flat bars rides on the first slide guide. A second arcuate slide guide is supported adjacent the radial face of the carding cylinder, and the second flat bar part of the flat bars rides on the second slide guide. The second slide guide is wedge-shaped and is shiftable in a circumferential direction of the carding cylinder.

By means of a longitudinal shift of the second slide guide a fine displacement of the slide surface of the second slide guide in the radial direction is possible so that the angle of orientation too, is variable in small steps and thus an optimal carding effect may be achieved.

DESCRIPTION OF THE PREFERRED EMBODIMENTS

Figure 1:
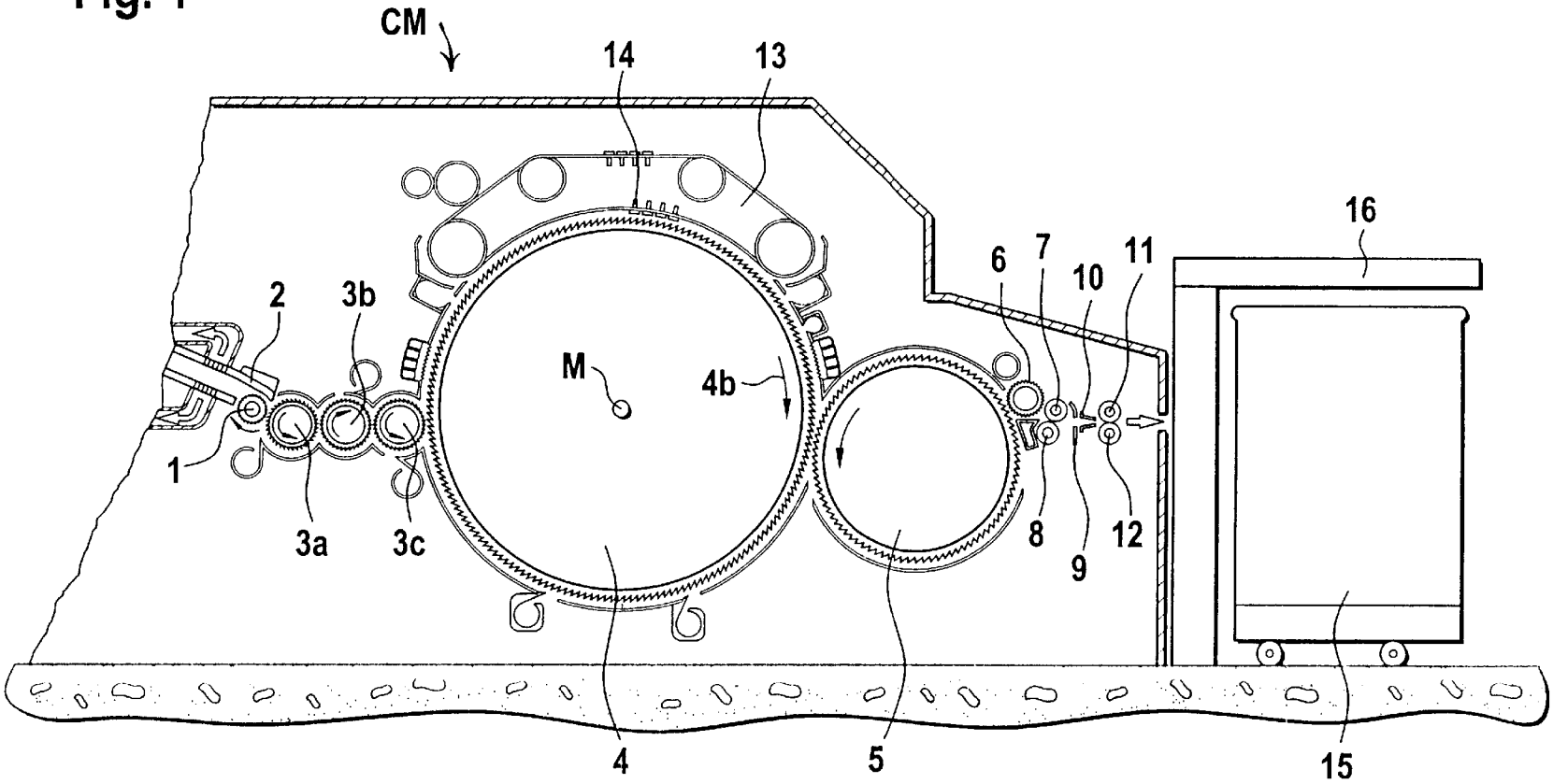
FIG. 1 is a schematic side elevational view of a carding machine adapted to incorporate the invention.
Figure 2:
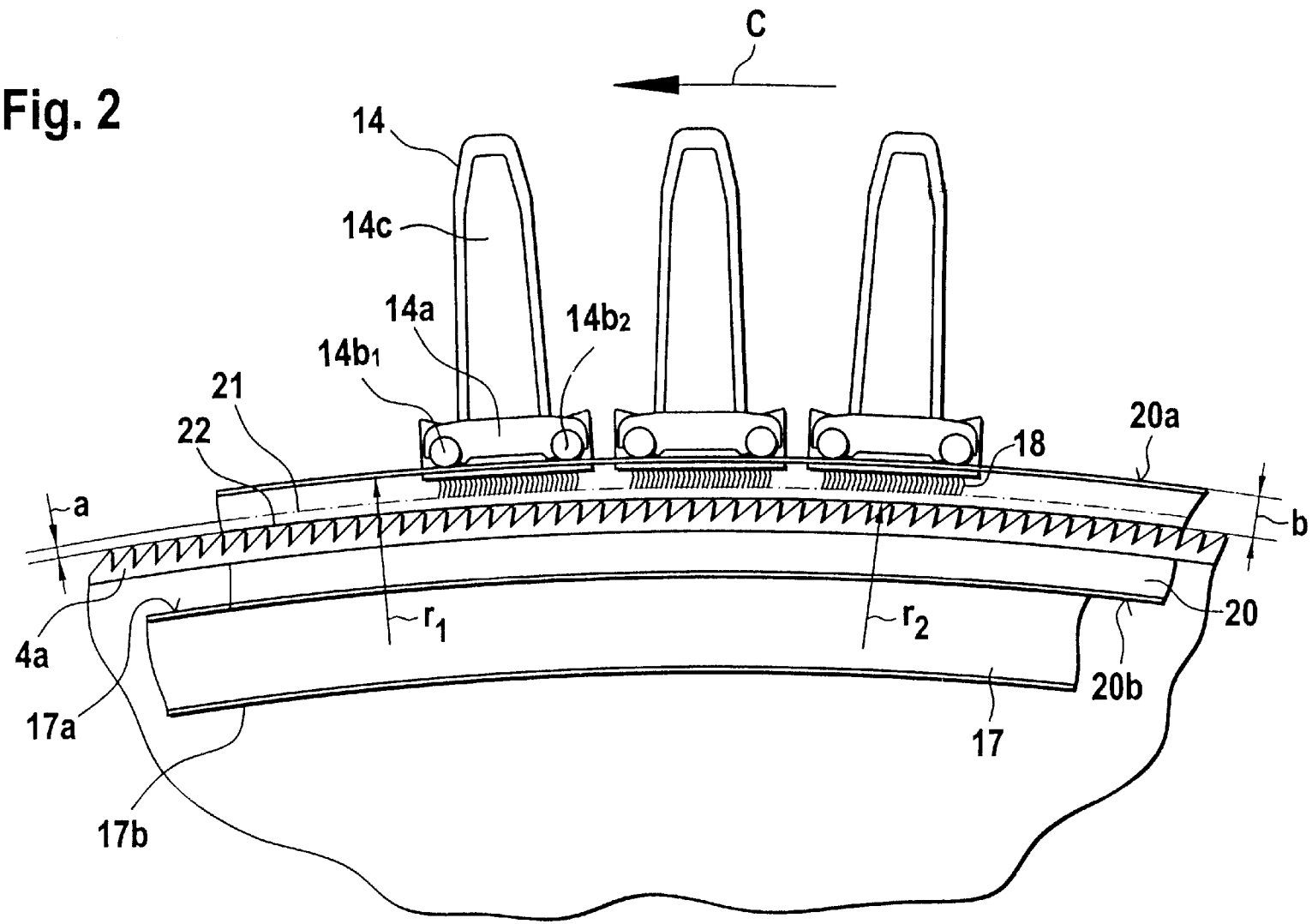
FIG. 2 is a fragmentary side elevational view of a carding cylinder, showing three flat bars of a traveling flats assembly cooperating with the carding cylinder.

FIG. 1 illustrates a carding machine CM which may be, for example, a high-performance DK 903 model manufactured by Trützschler GmbH & Co. KG, Mönchengladbach, Germany. The carding machine CM has a feed roller 1, a feed table 2 cooperating therewith, licker-ins 3*a*, 3*b*, 3*c*, a main carding cylinder 4, a doffer 5, a stripping roll 6, crushing rolls 7, 8, a web guiding element 9, a web trumpet 10, calender rolls 11, 12, a traveling flats assembly 13 having flat bars 14, a coiler can 15 and a sliver coiler 16 for depositing sliver into the coiler can 15. The axis of rotation of the carding cylinder 4 is designated at M, while the direction of rotation of the cylinder 4 is indicated by the arrow 4*b*.

Turning to FIGS. 2, 3*a*, 3*b* and 7, a flexible bend 17 is shown which is secured with screws 32 to the frame of the carding machine CM and adjoins one radial face of the carding cylinder 4. A similar, not visible, flexible bend is secured to the machine frame to adjoin the other, opposite radial cylinder face. The flexible bend 17 has a plurality of setscrews 31, a convex outer surface 17*a* and a concave underside 17*b*.

The flexible bend 17 supports a first slide guide 20 which has a convex outer surface 20*a* and a concave inner surface 20*b*. The flexible bend 17 also supports a second slide guide 23 only visible in FIGS. 3*a*, 3*b*. Both slide guides 20 and 23 are made of a low-friction plastic material. The concave inner surface 20*b* of the slide guide 20 lies on the convex outer surface 17*a*. Each flat bar 14 has a respective flat bar head 14*a* at opposite longitudinal flat bar ends. Each flat bar head 14*a* carries two steel pins (sliding pins) $14b_1$ and $14b_2$ which extend parallel to the flat bar length (that is, parallel to the cylinder axis M). The two pins $14b_1$ at opposite ends of the flat bar 14 glide on the convex outer surface 23*a* of the slide guides 23 (on opposite sides of the cylinder 4), whereas the two pins $14b_2$ at opposite ends of the flat bar 14 glide on the convex outer surface 20*a* of the slide guides 20 (on opposite sides of the cylinder 4) as the flat bars 14 travel in the direction of the arrow C. It is noted that in the structure depicted in FIGS. 2 and 3*a* the slide guides 23 (on opposite sides of the cylinder 4) and the slide guides 20 (on opposite sides of the cylinder 4) are at the same height level (that is, at the same radial distance from the axis M of the cylinder 4). A flat bar clothing 18 is secured to the underface of the carrier body 14*c* of each flat bar 14. An imaginary circle 21 is circumscribed about the points of the flat clothings 18 and an imaginary circle 22 is circumscribed about the points of the cylinder clothing 4*a* (for example, a sawtooth clothing) of the carding cylinder 4. The distance a between the circles 21 and 22 is, for example, 0.20 mm. The distance between the convex outer surface 20*a* and the circle 22 is designated at b. The radius of the convex outer surface 20*a* is designated at $r_l$ and the radius of the circle 22 is designated at $r_2$. The radii $r_1$ and $r_2$ intersect in the axis M of the carding cylinder 4.

Figure 3A:
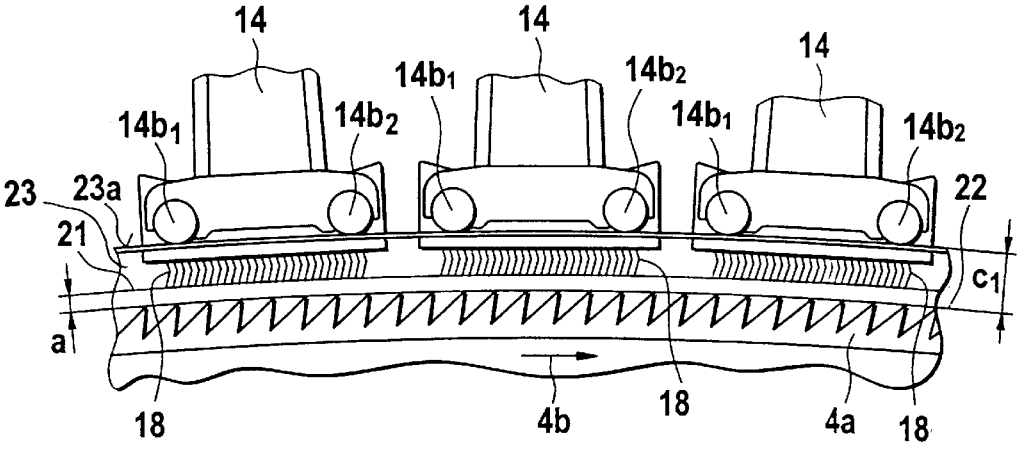
FIGS. 3*a* and 3*b* are fragmentary side elevational views of a carding cylinder, showing three flat bars before (FIG. 3*a*) and after (FIG. 3*b*) angular adjustment.
Figure 3B:
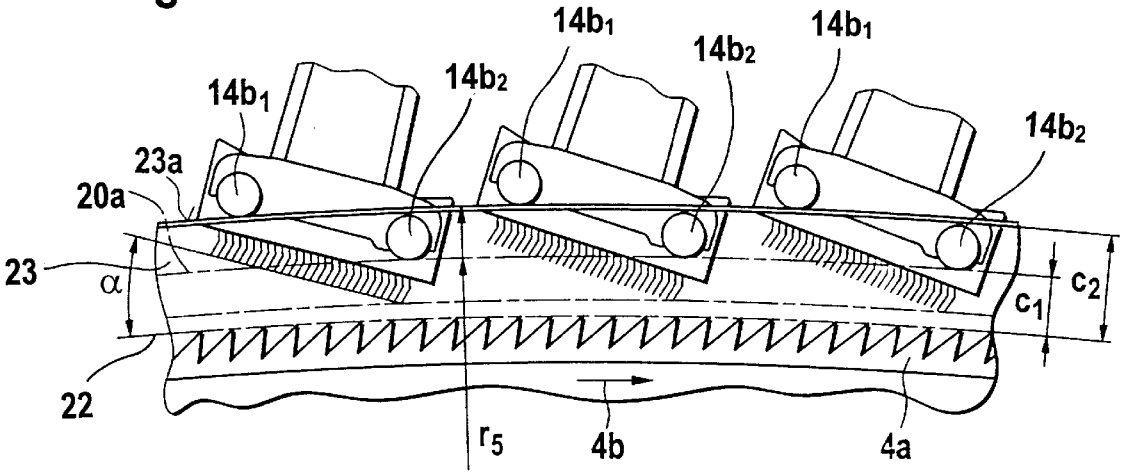

A comparison of FIG. 3*a* with FIG. 3*b* shows, in an exaggerated manner, the change of the angle a between the flat bar clothing 18 of each flat bar 14 and the tangent to the cylinder clothing 4*a* after the slide guide 23 has been shifted radially outwardly from its position shown in FIG. 3*a* into its position shown in FIG. 3*b*. In FIG. 3*a* the distance between the slide surface 23*a* of the slide guide 23 (and also the surface 20*a* of the slide guide 20) and the circle 22 is designated at $c_1$. As seen in FIG. 3*b*, the slide surface 23*a* has been shifted outwardly in the direction of the radius $r_5$; the distance between the slide surface 23*a* and the circle 22 is designated at $c_2$, whereas the distance between the slide surface 20*a* and the circle 22 remains $c_1$. The distance $c_1$ in FIGS. 3*a*, 3*b* corresponds to the distance b in FIG. 2. As a result, the pins $14b_1$ have a greater distance from the cylinder clothing 4*a* than the pins $14b_2$. In this manner at each flat bar 14 the circle 21 has an angle $\alpha$ which opens against the direction of cylinder rotation 4*b* and which may be, for example, 0°55' to the respective tangent drawn to the circle 22 of the cylinder clothing 4*a* .

Figure 4A:
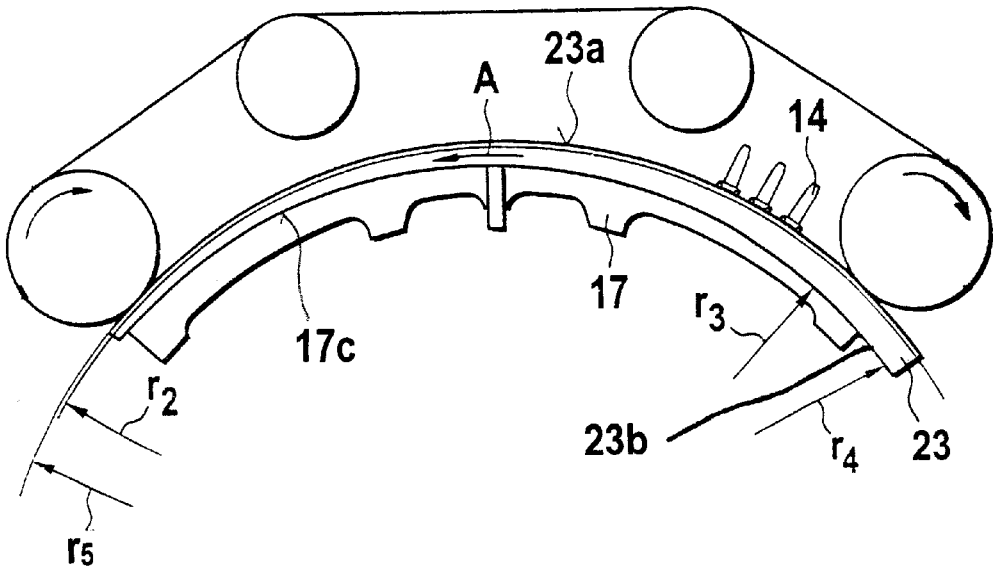
FIGS. 4*a* and 4*b* are schematic side elevational views of a flexible bend and a traveling flats assembly, showing a circumferentially shiftable, wedge-shaped slide guide in a first position (FIG. 4*a*) and in a second position (FIG. 4*b*).
Figure 4B:
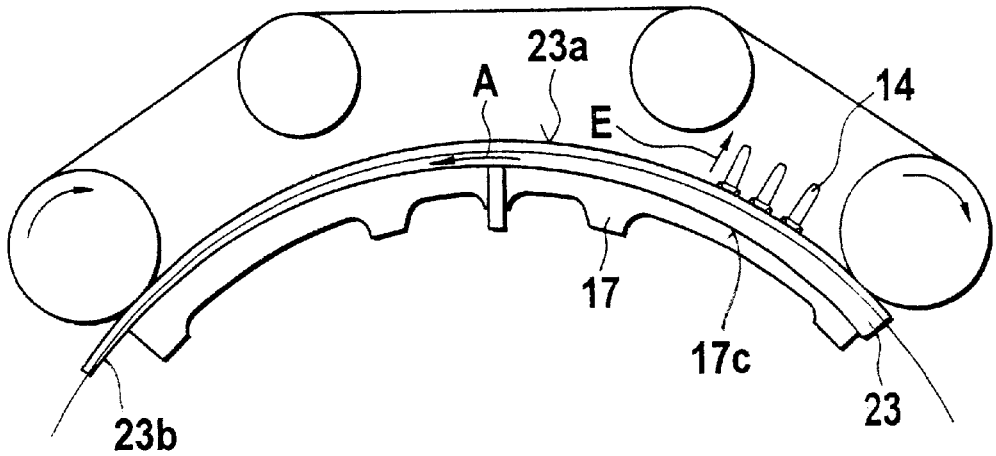

Turning to FIGS. 4*a* and 4*b*, by the shift of the wedge-shaped second slide guide 23 on the flexible bend 17 in the direction of the arrow A is shown. By circumferentially shifting the slide guide 23 in the direction of the arrow A on and with respect to the flexible bend 17, the distance $c_2$ (FIG. 3*b*) between the pins $14b_1$ and the cylinder clothing 4*a* is enlarged. Thus, by virtue of the fact that the slide guide 23 is shifted in the direction A, the pins $14b_1$ of the flat bars 14 are lifted in the direction E from the position shown in FIG. 4*a* into the position shown in FIG. 4*b*. The slide surface 23*a* of the slide guide 23 is concentric with the cylinder axis M. The circumferentially changing radius $r_3$ of supporting surface 17*c* of the flexible bend 17 in cooperation with the circumferentially changing radius $r_4$ of the concave inner surface (underside) 23*b* of the slide guide 23 results in the change of the radius $r_5$ of the slide surface 23*a* as the slide guide 23 is caused to circumferentially shift on the flexible bend 17.

Figure 5A:
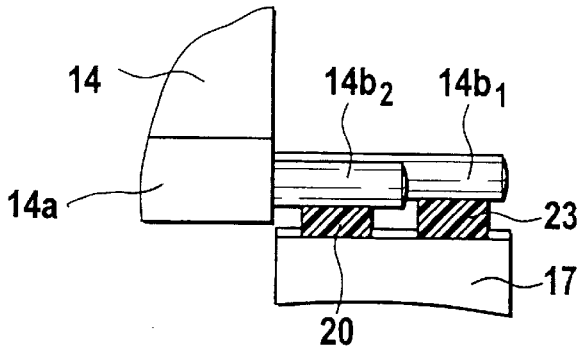
FIGS. 5*a* and 5*b* are fragmentary front elevational and, respectively, top plan views of a preferred embodiment of the invention.
Figure 5B:
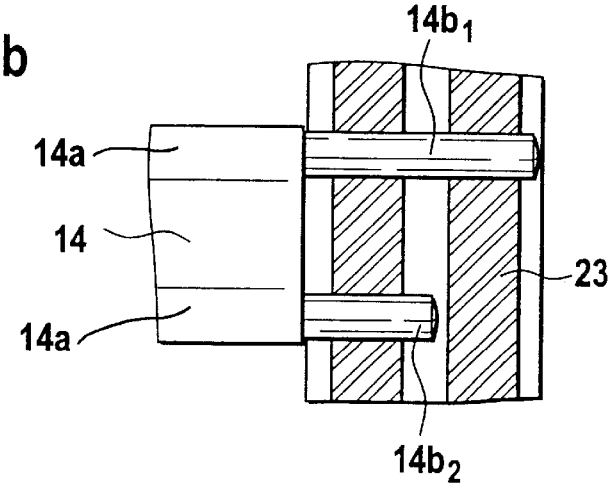

FIGS. 5*a*, 5*b* show a preferred embodiment of the invention at one end of the flat bar 14, supported on the flexible bend 17. The slide guides 20 and 23 extend side-by side and are seated in respective circumferential grooves provided in the flexible bend 17. The pin $14b_1$ which is longer than the pin $14b_2$ runs on the slide surface 23*a* of the circumferentially shiftable slide guide 23 for changing the orientation angle $\alpha$, as described earlier. The shorter pin $14b_2$ runs on the slide surface 20*a* of the first slide guide 20.

Figure 6A:
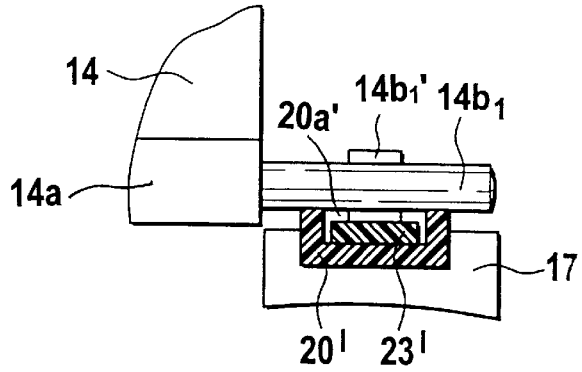
FIGS. 6*a* and 6*b* are schematic front elevational and, respectively, top plan views of a further preferred embodiment of the invention.
Figure 6B:
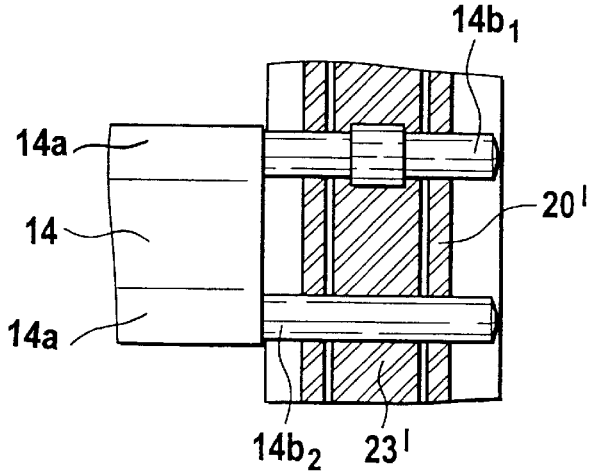

According to another preferred embodiment shown in FIGS. 6*a*, 6*b*, the slide guide 23' is disposed in a longitudinal groove 20*a*' of the slide guide 20' which, in turn, is supported in a groove provided in the flexible bend 17. The pin $14b_1$ is modified, for example, by a cylindrical jacket $14b_1$' which projects into the groove 20*a*' of the slide guide 20' to thus contact the upper surface (slide surface) of the circumferentially shiftable slide guide 23'.

Figure 7:
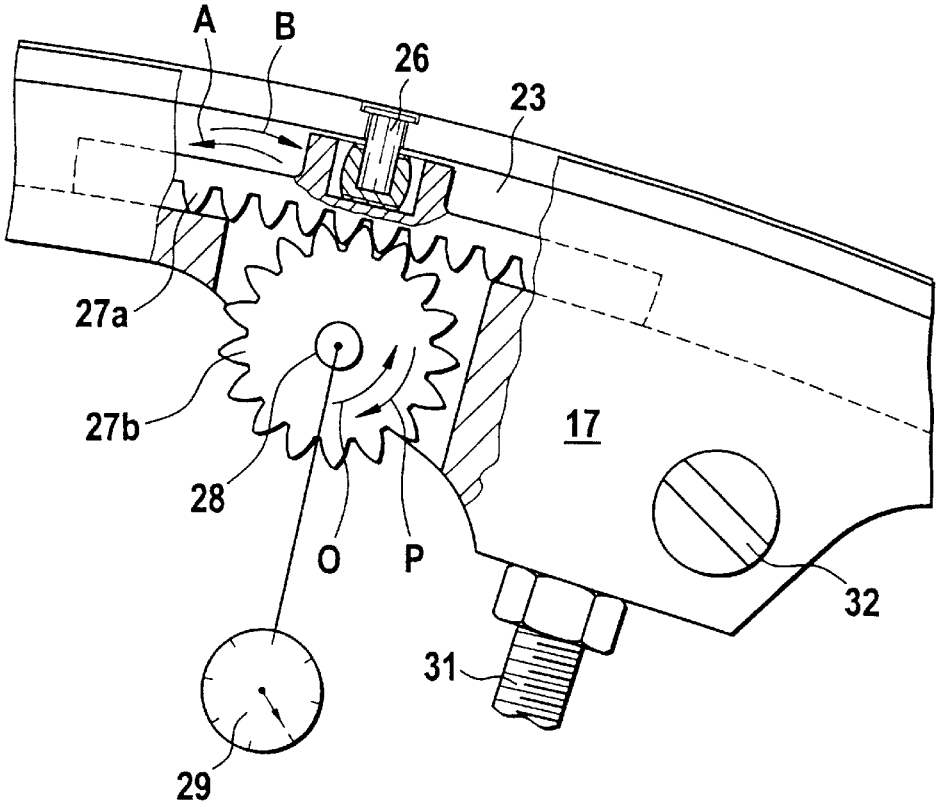
FIG. 7 is a schematic side elevational view of a shifting mechanism for the second slide guide.

Turning to FIG. 7, on the slide guide 23 a carrier element 26 is arranged which is coupled with a toothed rack 27*a*. The latter, in turn, meshes with a gear 27*b* which is rotatable in the direction O, P. The gear 27*b* is driven by a reversible motor 28, whereby the slide guide 23 is shiftable circumferentially in the direction of the arrows A, B. The motor 28 is connected with an inputting device 29 with which the desired distance $c_2$ (see FIG. 3*b*) and thus the desired orientation angle a may be predetermined as a nominal value. The above-described adjustment of the radius of a slide surface of a slide guide by circumferentially shifting the slide guide is described in further detail in U.S. Pat. No. 5,918,349.

Figure 8:
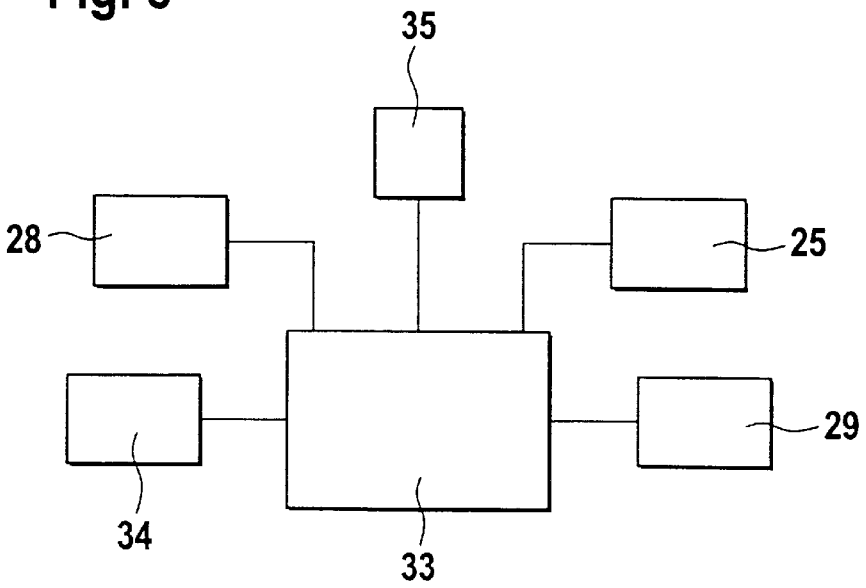
FIG. 8 is a block diagram of an electronic control and regulating device for operating the adjusting device according to the invention.

According to FIG. 8, an electronic control and regulating device 33, for example, a microcomputer is provided which is connected to an inputting device 34 for setting the desired distance $c_2$ and thus the orientation angle $\alpha$. The device 33 is also connected to the motor 28, an indicating or display device 25, a nominal value inputting device 29 and a switching element 35.

It will be understood that the above description of the present invention is susceptible to various modifications, changes and adaptations, and the same are intended to be comprehended within the meaning and range of equivalents of the appended claims.

What is claimed is:

1. A carding machine comprising:

(a) a carding cylinder carrying a cylinder clothing; said carding cylinder having a cylinder axis;

(b) a plurality of flat bars forming part of a traveling flats assembly; each flat bar having (1) a flat bar clothing carried on an underside of the flat bar for cooperating with the cylinder clothing;

(2) a first flat bar part disposed at a longitudinal flat bar end; and (3) a second flat bar part disposed at said longitudinal flat bar end and being spaced from said first flat bar part in a circumferential direction of said carding cylinder;

(c) a first arcuate slide guide supported adjacent a radial face of said carding cylinder; said first arcuate slide guide having a first slide surface being concentric with said cylinder axis as viewed in said circumferential direction; said first flat bar part of said flat bars riding on said first slide surface as the flat bars travel along a circumferential portion of said carding cylinder;

(d) an arcuate support situated adjacent said radial face of said carding cylinder and extending in said circumferential direction; said arcuate support having a supporting surface having a gradually changing distance from said cylinder axis as viewed in said circumferential direction;

(e) a second arcuate slide guide supported on said arcuate support adjacent said radial face of said carding cylinder; said second arcuate slide guide having (1) a second slide surface being concentric with said cylinder axis as viewed in said circumferential direction; said second flat bar part of said flat bars riding on said second slide surface of said second slide guide as the flat bars travel along a circumferential portion of said carding cylinder;

(2) an underside having a gradually changing distance from said cylinder axis as viewed in said circumferential direction; said underside of said second arcuate guide being positioned on said supporting surface of said arcuate support; and (f) operating means for shifting said second slide guide in said circumferential direction relative to said arcuate support for varying a radial height position of said second flat bar portion of said flat bars dependent on a circumferential position of said second slide guide, thereby varying an angle of inclination of said flat bar clothings to said cylinder clothing.

2. The carding machine as defined in claim 1, wherein said first and second flat bar parts are, respectively, first and second sliding pins of unequal length extending from said longitudinal flat bar end; said first and second slide guides extending side-by-side; one of said first and second slide guides being closer to said radial face of said carding cylinder than the other of said first and second slide guides; the shorter of said first and second sliding pins being arranged to glide on the slide surface of the slide guide closer to said radial face and the longer of said first and second sliding pins being arranged to glide on the slide surface of the slide guide more remote from said radial face.

3. The carding machine as defined in claim 1, wherein said first and second flat bar parts are, respectively, first and second sliding pins extending from said longitudinal flat bar end; said second sliding pin being longer than said first sliding pin; said first and second slide guides extending side-by-side; said first slide guide being closer to said radial face of said carding cylinder than said second slide guide; said first sliding pin being arranged to glide on said first slide surface of said first slide guide and said second sliding pin being arranged to glide on said second slide surface of said second slide guide.

4. The carding machine as defined in claim 1, wherein said first and second flat bar parts are, respectively, first and second sliding pins extending from said longitudinal flat bar end; said first slide guide having a longitudinal groove accommodating therein said second slide guide; said second slide guide being recessed in said first slide guide; said first sliding pin being arranged to glide on said first slide guide; and said second sliding pin having a pin portion aligned with said groove; said pin portion projecting into said groove and gliding on said second slide guide.

5. The carding machine as defined in claim 1, wherein said operating means includes an electronic control and regulating device.

6. The carding machine as defined in claim 1, wherein said operating means includes an electronic control and regulating device and an inputting device connected to said electronic control and regulating device for inputting signals representing a predetermined magnitude of said angle of inclination.

7. A carding machines, comprising:

a carding cylinder carrying a cylinder clothing;

a plurality of flat bars forming part of a traveling flats assembly; each flat bar having a flat bar clothing carried on an underside of the flat bar for cooperating with the cylinder clothing said flat bar clothing of said flat bars being oriented at an adjustable angle to said cylinder clothing;

a first flat bar part disposed at a longitudinal flat bar end; and a second flat bar part disposed at said longitudinal flat bar end;

a first arcuate slide guide supported adjacent a radial face of said carding cylinder, said first flat bar part of said flat bars riding on slid first slide guide as the flat bars travel along a circumferential portion of said carding cylinder;

a second arcuate slide guide supported adjacent said radial face of said carding cylinder, said second flat bar part of said flat bars riding on said second slide guide as the flat bars travel along a circumferential portion of said carding cylinder; and means for shifting said second slide guide in a circumferential direction of said carding cylinder, said second slide guide being wedge-shaped as viewed in said circumferential direction.

* * * * *